US005528280A

United States Patent [19]

Endo et al.

[11] Patent Number: 5,528,280

[45] Date of Patent: Jun. 18, 1996

[54] LABEL PRINTING APPARATUS FOR LASER PRINTING A HEAT-SENSITIVE COLOR DEVELOPING INK LAYER OF THE LABEL

[75] Inventors: Norio Endo; Yasuharu Sawahara; Naoyuki Nagae; Shinichi Ogata, all of Tokyo; Toshiyuki Kiyonari, Hasuda; Yoshio Takimoto, deceased, late of Tokyo; Takimoto, Heirs Taheshi, Kazumi; Toshihiko Yasui, Yokohama; Katsuhilo Kawakami, Shisui-machi, all of Japan

[73] Assignees: Kirin Beer Kabushiki Kaishas; Dainippon Ink and Cemicals, Inc., both of Tokyo, Japan

[21] Appl. No.: 157,291

[22] Filed: Nov. 26, 1993

[30] Foreign Application Priority Data

Nov. 30, 1992 [JP] Japan ..... 4-320086
Nov. 30, 1992 [JP] Japan ..... 4-320587

[51] Int. Cl.[6] ..... B41J 2/47

[52] U.S. Cl. ..... 347/262; 346/135.1

[58] Field of Search ..... 347/262, 264; 346/135.1

[56] References Cited

U.S. PATENT DOCUMENTS 4,260,998 4/1981 Fukui ..... 347/262
4,946,261 8/1990 Yaegashi et al. ..... 347/262
5,323,178 6/1994 Mohnkern et al. ..... 347/262
5,413,629 5/1995 Yasui et al. ..... 106/21

*Primary Examiner*—Mark J. Reinhart
*Attorney, Agent, or Firm*—Oblon, Spivak, McClelland, Maier & Neustadt

[57] ABSTRACT

The label printing apparatus has a structure including: a label feed means for successively feeding plural labels, each having an information printing area including a heat-sensitive color developing ink layer, to predetermined printing positions; a laser printing device which is provided with a sensor and a light source, said sensor serving to discriminate between presence and absence of the label in the predetermined printing position and to output a label detection signal, said light source serving to release a laser beam, and which receives the label detection signal directly from the sensor, prints information on the label by means of the laser beam when the presence of the label on the predetermined printing position is confirmed by the label detection signal, and outputs a shot signal; and a controller to discriminate whether the output interval between the shot signals is within a given period of time or not and to output an error signal when the output interval between the shot signals is not within the given period of time. Owing to the above-mentioned structure, the label printing apparatus of the present invention can be easily controlled, is free from any useless motion and is able to reduce occurrence of a defective.

16 Claims, 5 Drawing Sheets

LABEL PRINTING APPARATUS FOR LASER PRINTING A HEAT-SENSITIVE COLOR DEVELOPING INK LAYER OF THE LABEL

BACKGROUND OF THE INVENTION

The present invention relates to an apparatus for printing information on a label or other various indicator materials, and more particularly to a label printing apparatus for printing information such as a production date of a content in a container (e.g., bottle) and a lot number thereof on a label to be attached to the container.

A conventional labeling machine used for attaching a label onto a container such as a bottle is provided with, for example, a cylinder having on its peripheral surface a plurality of vacuum holders to transfer labels by means of vacuum suction. The peripheral surface of the cylinder is provided with a label magazine for feeding labels in a given direction, for example, in the right rotation direction or the left rotation direction, a laser printing device for printing information such as a lot number and a production date on the label, and a paste application device for applying paste to the label held by the vacuum holder by means of a rotating roller.

The vacuum holder provided on the peripheral surface of the cylinder rotates in accordance with the rotation of the cylinder and receives the label from the label magazine by means of vacuum suction. Then, the back surface of the label is applied with paste by the paste application device while the label is held by the vacuum holder. The vacuum holder transfers the label to a bottle which is conveyed by a belt conveyer, and attaches the label onto the side surface of the bottle.

Onto a driving means for rotating the cylinder, an absolute encoder that outputs data of the rotation absolute position of the cylinder is fitted. Based on the data of the rotation absolute position output from the absolute encoder, the laser printing device prints various information such as a production date, a lot number and a factory number on the label transferred by the vacuum holder.

However, the absolute encoder for detecting the absolute position, which is used for the above-described conventional labeling machine, has a scatter of about 0.5 msec in the response time. Supposing labels each having a size of about 5 cm×6 cm are attached at a rate of 1,000 sheets/min, the relative moving rate of the label to the printing position of the laser printing device would be about 2 mm/msec. This means that a deviation of about 2 mm arises in the printing position because the printing starting time is delayed 1 msec.

Therefore, the printing position deviates by about 1 to 2 mm due to the scatter in the response time of the absolute encoder.

In the above-mentioned labeling machine, detected is not a real position of the label but a position of the cylinder for holding and transferring the label. For this reason, if a deviation is present between the detected position of the cylinder and the real position at which the label is held, printing in the correct position of the label is difficult. Moreover, even when the vacuum holder does not hold a label, the printing operation is carried out by the laser, thereby to cause waste of electric power and damage of the vacuum holder. For avoiding such disadvantage, it is necessary to conduct a complicated control, resulting in a new problem.

U.S. Pat. No. 4,844,769 discloses a labeling machine provided with a printing monitor. This labeling machine includes plural pallets rotating along a predetermined track on a pallet rotor, a paste application device arranged in the direction of the pallet's rotation, a label magazine, a printing device, and a print-reading detection head. The print-reading detection head (for example, constructed by a camera) discriminates whether printing on the label has been done or not by the printing device.

In the conventional labeling machine described above, however, the real position of the label is not detected, and therefore there resides a problem of difficult printing in the correct position on the label. Moreover, there is other problem that printing is made even when the pallet does not hold the label.

By the way, the above-mentioned laser printing is mainly carried out by irradiating only the necessary portion of a substrate surface with a laser beam to heat that portion of the substrate so as to modify or remove the portion, or by irradiating a film coated on a substrate surface with a laser beam to remove only the film so as to form a contrast between the laser-irradiated portion (printed portion) and the unirradiated portion (ground portion).

However, in the method of removing the printing ink for example, a high contrast between the substrate paper and the printing ink is necessary, and hence sharp printing on a pale white label is impossible. Further, the removal of the printing ink (material destruction) causes roughening of a border between the irradiated portion and the unirradiated portion, whereby accurate printing cannot be obtained. On that account, use of heat-sensitive color development by means of irradiation of a label having a paper substrate with a laser beam, that is non-destructive type color development, has been proposed, and a variety of applied examples are known in literatures (e.g., Japanese Patent Laid-Open Publications No. 52442/1978, No. 11857/1980 and No. 148695/1984), but none of them have been practically used yet.

SUMMARY OF THE INVENTION

It is an object of the present invention to provide a label printing apparatus which can be easily controlled, is free from any useless motion and is able to perform printing in the correct position at a high speed.

There is provided by the present invention a label printing apparatus to print given information by means of a laser beam on an information printing area of a label, said information printing area having a heat-sensitive color developing ink layer; said label printing apparatus including:

a label feed means for successively feeding plural labels to predetermined printing positions;

a laser printing device which is provided with a sensor and a light source, said sensor serving to discriminate between presence and absence of the label in the predetermined printing position and to output a label detection signal, said light source serving to release the laser beam, and which receives the label detection signal directly from the sensor, prints the information on the label by means of the laser beam when the presence of the label in the predetermined printing position is confirmed by the label detection signal, and outputs a shot signal; and a controller to discriminate whether the output interval between the shot signals is within a given period of time or not and to output an error signal when the output interval between the shot signals is not within the given period of time.

According to the present invention, owing to such a structure as mentioned above, the sensor reliably and rapidly detects the presence of a label to be printed by a laser in the predetermined printing position, and the information printing operation is automatically carried out only when the label is present in the predetermined position. Hence, the label printing apparatus can be easily controlled and is free from any useless motion. In addition, printing can be carried out in the correct position of the label at a high speed, and occurrence of a defective can be reduced.

DETAILED DESCRIPTION OF PREFERRED EMBODIMENT

A preferred embodiment of the present invention will be described below with reference to the attached drawings.

Figure 1:
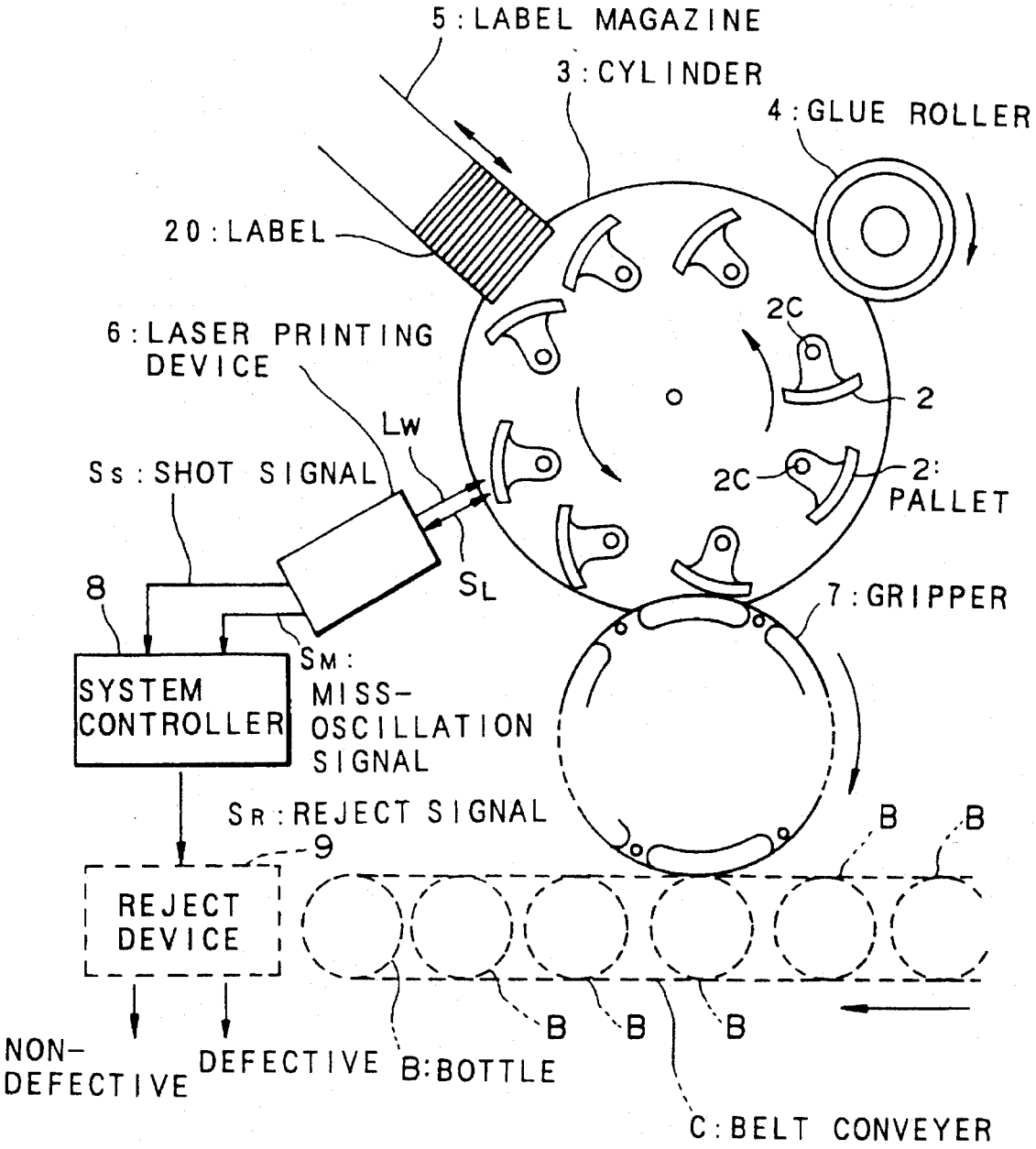
FIG. 1 is a schematic block diagram showing a structure of a main part of a labeling machine.

FIG. 1 is a schematic block diagram showing a structure of a main part of a labeling machine. In FIG. 1, a labeling machine 1 includes a cylinder 3 having plural pallets 2 for transferring labels. On the periphery of the cylinder 3, a glue roller 4, a label magazine 5, a laser printing device 6, a gripper 7 and a system controller 8 for controlling the whole apparatus are provided in this order in the anti-clockwise direction (left rotation direction). The glue roller 4 serves to apply glue onto the label through the pallet 2; the label magazine 5 serves to feed the label; and the laser printing device 6 serves to print information such as a lot number and a production date on the label. The gripper 7 serves to receive the label having printed information thereon from the pallet 2 by means of vacuum suction, then to transfer the label to the side of a belt conveyer C for conveying bottles B, and to attach the label to the bottle B.

Each of the pallets 2 provided on the upper surface of the cylinder 3 individually rotates on its rotating shaft 2C, as well as revolves in accordance with the rotation of the cylinder 3, and on the surface of each pallet 2 is applied glue by the glue roller 4. Thereafter, the label is held by the pallet 2 due to the adhesion of the glue and is transferred to the gripper 7.

Figure 2:
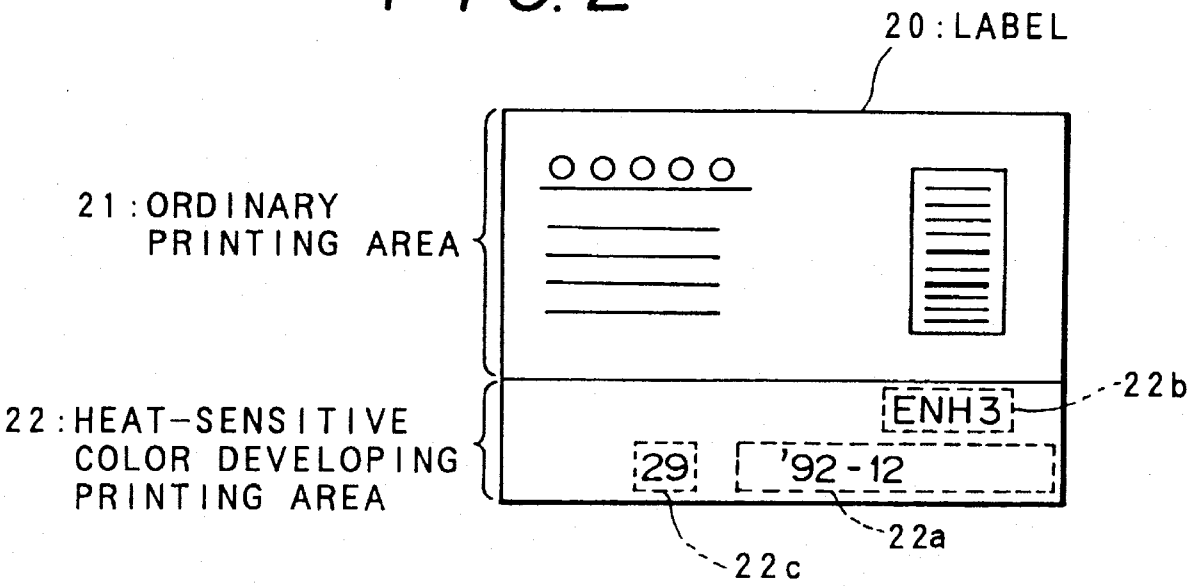
FIG. 2 is a view showing a structure of a label.
Figure 3:
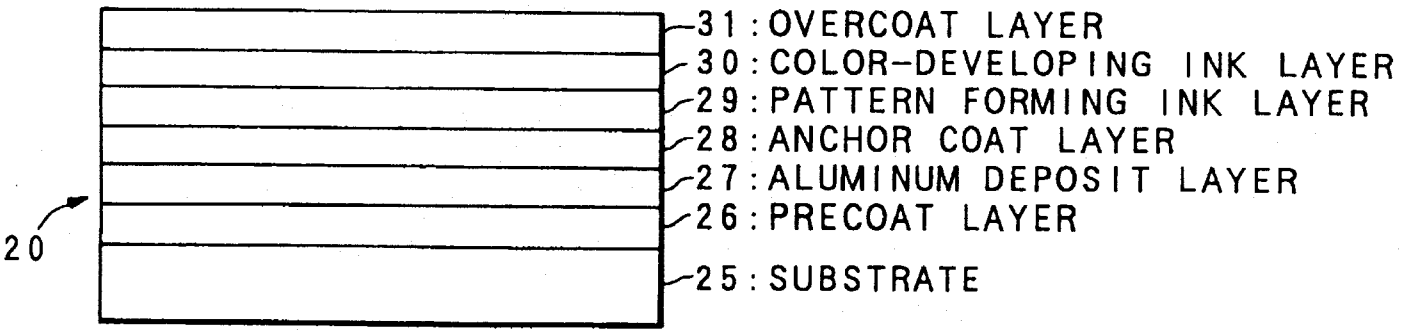
FIG. 3 is a vertical cross-sectional view of a heat-sensitive color developing area.

FIG. 2 and FIG. 3 are each a view showing a structure of a label. FIG. 2 shows a surface of the label 20 on which printing is to be made. The surface of the label 20 has an ordinary printing area 21 where printing has been done using an ordinary ink and a heat-sensitive color developing printing area 22 where a heat-sensitive color developing ink is applied.

On the ordinary printing area 21, information common to the product, for example, name of product, amount of content, description of the product and bar code, is printed.

On the heat-sensitive color developing printing area 22, individual information of the product, for example, information on production date 22*a* of the content, lot number 22*b* and information on factory 22*c*, is printed.

FIG. 3 is a sectional view of the heat-sensitive color developing printing area 22 of the label 20. The label 20 has a substrate 25 such as a paper substrate and a precoat layer 26 (thickness: about 4 μm) made of an aminoalkyd type resin provided on the substrate. On the precoat layer 26, an aluminum deposit layer 27 (thickness: 300 to 1,000 mμ) formed by deposition of aluminum is provided. On the aluminum deposit layer 27, a pattern forming ink layer 29 (nitrocellulose type resin) is provided through an anchor coat layer 28 (thickness: about 1.5 μm) made of an acrylic resin, namely, an undercoat layer.

Further, on the pattern forming ink layer 29, a color developing ink layer 30 (thickness: about 2 μm) which reacts to heat generated by the irradiation with the laser beam to develop color and an overcoat layer 31 (thickness: about 2 μm) containing a nitrocellulose type resin as a vehicle are laminated in this order.

The color developing ink layer 30 for forming the heat-sensitive color developing printing area 22 of the label 20 is now described.

The color developing ink layer 30 is formed by printing a heat-sensitive color developing ink comprising a ground color inhibitor, a binder resin, a solvent, a color former and a color developer.

The ground color inhibitor contains at least one element selected from the group consisting of amino acids, ammonium salts, a pH buffer solution, a surface-active agent, etc. That is, there are various substances useful as the ground color inhibitor. Though details of the various useful substances will be described later, it is assumed that they inhibit the color former and/or the color developer from being accidentally dissolved in the system prior to irradiation with the laser beam or inhibit the color former and the color developer from being contacted with each other to develop a color, and they have a close correlation with the color former, the color developer, the medium, etc. Hence, the object of such inhibition can be effectively achieved by selecting an appropriate combination from those useful substances.

Such useful substances are broadly classified into two categories, that is, various ionizing materials (electrolytically dissociating materials) which ionize in the printing ink and various surface-active agents.

Examples of the ionizing materials include amino acids, ammonium salts, water and various pH buffer solutions of neutral, acidic and alkaline types. The amino acids, ammonium salts and water may be used per se or in the form of an aqueous solution. Examples of the surface-active agents include those of various ionic types such as anionic type, cationic type, nonionic type and amphoteric type; and those of silicone type. These ground color inhibitors may be used singly or in combination.

The ionizing material, that is the ground color inhibitor, is dissolved in the ink system when added to the system to bring about dissociation of ion (ionization or electrolytic dissociation) in a substantial amount, and this assumably acts directly or indirectly in some way or other to inhibit the ground from color development. Such an ionizing material as described above is a material which substantially exhibits a ground color inhibiting action, and even if other ionizing material is present as a coexisting color developer or a laser marking sensitizer, the above-mentioned ionizing material is separately added to the system. This ionizing material may be a compound or a mixture of compounds, or it may be used as its aqueous solution. Further, water exerts the ground color inhibiting effect independently in some cases, and therefore, water is included in the ionizing materials for convenience. The amino acids, particularly water-soluble amino acids, ammonium salts, particularly ammonium salts of inorganic acids, and pH buffer solutions are preferred as the ionizing material. Some of the surface-active agents described later correspond to the ionizing material. For example, there can be mentioned anionic surface-active agents and cationic surface-active agents.

The pH buffer solution employable as the ground color inhibitor includes an acidic buffer solution having a pH value of not more than 7 and an alkaline buffer solution having a pH value of not less than 7. As the acidic buffer solution having a pH value of not more than 7, any of generally known buffer solutions can be employed, and some examples of the compositions of such buffer solutions are described below for reference. That is, there are Clark-Lubs' buffer solutions such as those of potassium chloride-hydrochloric acid type, potassium hydrogenphthalate-hydrochloric acid type, potassium hydrogenphthalate-sodium hydroxide type and potassium dihydrogenphosphate-sodium hydroxide type; Sφrensen's buffer solutions such as those of glycine-sodium chloride-hydrochloric acid type, sodium citrate-hydrochloric acid type and potassium dihydrogenphosphate-disodium hydrogenphosphate type; Kolthoft's buffer solutions such as those of potassium hydrogencitrate-citric acid type, potassium citrate-hydrochloric acid type, succinic acid-borax type, potassium hydrogencitrate-borax type and potassium dihydrogenphosphate-borax type; Michaelis' buffer solutions such as those of tartaric acid-sodium tartrate type, lactic acid-sodium lactate type, acetic acid-sodium acetate type, potassium dihydrogenphosphate-disodium hydrogenphosphate type and sodium diethylbarbiturate-hydrochloric acid type; and Gomori's buffer solutions such as those of 2,4,6-trimethylpyridine-hydorchloric acid type.

As the alkaline buffer solution having a pH value of not less than 7, any of generally known buffer solutions can be employed, and some examples of the compositions of such buffer solutions are described below for reference. That is, there are Clark-Lubs' buffer solutions such as those of potassium dihydrogenphosphate-sodium hydroxide type and boric acid-potassium chloride-sodium hydroxide type; Sφrensen's buffer solutions such as those of glycine-sodium chloride-sodium hydroxide type, borax-hydrochloric acid type and borax-sodium hydroxide type; Kolthoft's buffer solutions such as those of potassium dihydrogenphosphate-borax type, borax-sodium carbonate type and potassium dihydrogenphosphate-sodium hydroxide type; Michaelis' buffer solutions such as those of ammonium chloride-ammonia water type, sodium dimethylglycine-hydrochloric acid type and sodium diethylbarbiturate-hydrochloric acid type; Atkins-Pautin's buffer solutions such as those of boric acid-potassium chloride-sodium carbonate type; Menzel's buffer solutions such as those of sodium carbonate-sodium hydrogencarbonate type; and Gomori's buffer solutions such as those of 2-aminomethyl-1,3-propanediol-hydrochloric acid type.

The surface-active agent employable as the ground color inhibition includes any of anionic, cationic and nonionic surface-active agents.

As the anionic surface-active agent, any of generally known anionic surface-active agents can be employed. Of various anionic surface-active agents, particularly useful are salts of polycarboxylic acid. Examples of the salts of polycarboxylic acid include alkali metal salts of polycarboxylic acid, alkaline earth metal salts thereof, ammonium salts thereof and organic amine salts thereof. Some concrete examples of the useful anionic surface-active agents are listed below, but it should be construed that the present invention is in no way limited to those examples.

Anti-Terra-203*, Anti-Terra-204*, Disperbyk*, BYK-W910*, BYK-W960*, all available from Bic Chemy Co.

Sharol AN-103P*, Discol F-100*, Discoat N-14*, all available from Dai-Ichi Kogyo Seiyaku Co., Ltd.

As the cationic surface-active agent, any of generally known quaternary ammonium salt type cationic surface-active agents can be employed. Examples of such surface-active agents include Sharol DC-902P* and Sharol DM-283P* both available from Dai-Ichi Kogyo Seiyaku Co., Ltd.

Examples of the nonionic surface-active agent include special surface-active agents, such as Homogenol L-18*, L-95* and L-1820* all available from Kao Co., Ltd. and Discol N-202* and Discol N-518* both available from Dai-Ichi Kogyo Seiyaku Co., Ltd.

As the amino acid for the ground color inhibitor, any of neutral, acidic and basic amino acids may be employed. Examples of such amino acids include glycine, alanine, sarcosine, cistine, asparagic acid, lysine, serine, threonine, α-methylserine, tyrosine and oxyproline. Though these amino acids are added to the system as an aqueous solution having a nearly saturated concentration, they may be added in the solid form when water is contained in the system before addition thereof.

Employable as the binder resin for forming the heat-sensitive color developing ink is a neutral resin which is soluble in the solvent described below and capable of forming a film.

Employable as the solvent for forming the heat-sensitive color developing ink is a lower alcohol or a mixture of a lower alcohol and water.

As the alcohol used as the solvent, there can be mentioned lower alcohols having 1 to 12 carbon atoms. However, if inhibition of the ground color development is keenly desired according to the use application, lower alcohols having 1 to 4 carbon atoms are preferably used. The water used as the solvent is preferably pure water or ion-exchanged water.

The water which is post-added to the system if necessary is in no way limited to pure water, and any water such as tap water and well water may be used, as far as it has a pH value of 5 to 8 and contains no insoluble or ununiform particle. In the case of a non-aqueous system where any water is not used as a solvent, this post-additional water is very effective.

As the color former for forming the heat-sensitive color developing ink, there can be employed any of color developing materials which are generally used for heat-sensitive recording media, for example, color developing colorless dyes which react with acid substances or basic substances to develop color, color developing colorless dyes which react with oxidizing agents or reducing agents to develop color, phthalide compounds which per se generate acid substances by heat energy to independently develop color, dye precursors which develop color through various reactions, and thermo-color pigments. Concrete examples of such color developing materials include leuco dyes of triphenylmetaphthalide type, phenothiazine type, spiropyran type, rhodamine lactam type, leucomyran type and fluoran type. Of these, fluoran type leuco dyes are preferred.

Concrete examples of the leuco dyes include 3,3-bis(p-dimethylaminophenyl) phthalide, 3,3-bis (p-dimethylaminophenyl)-6-dimethylaminophthalide (another name: crystal violet lactone or CVL), 3,3-bis(p-dimeylaminophenyl)-6-aminophthalide, 3,3-bis(p-dimethylaminophenyl)-6-nitrophthalide, 3,3-bis(p-dimethylaminophenyl)phthalide, 3,3-bis-3-dimethylamino-7-methylfluoran, 3-diethylamino-7-chlorofuran, 3-diethylamino-6-chloro-7-methylfluoran, 3-diethylamino-7-anilinofluoran, 3-diethylamino-6-methyl-7-anilinofluoran, 2-(2-fluorophenylamino)-6-diethylaminofluoran, 2-(2-fluorophenylamino)-6-di-n-butylaminofluoran, 3-piperidino-6-methyl-7-anilinofluoran, 3-(N-ethyl-p-toluidino)-7-(N-methylanilino)fluoran, 3-(N-ethyl-p-toluidino)-6-methyl-7-anilinofluoran, 3-N-ethyl-N-isoamylamino-6-methyl-7-anilinofluoran, 3-N-methyl-N-cyclohexylamino-6-methyl-7-anilinofluoran, 3-N,N-diethylamino-7-o-chloroanilinofluoran, rhodamine B lactam, 3-methylspirodinaphthopyran, 3-ethylspirodinaphthopyran and 3-benzylspironaphthopyran.

As the color developer for forming the heat-sensitive color developing ink, any of acid materials which are generally used as electron acceptors for heat-sensitive recording media can be employed. Examples of such acid materials include inorganic substances such as activated clay and acid clay; inorganic acids; aromatic carboxylic acids; anhydrides of the aromatic carboxylic acids; metal salts of the aromatic carboxylic acids; and organic color developers such as organic sulfonic acids, other organic acids and phenyl type compounds. Of these, phenol type compounds are preferred. (Salts of the phenol type compounds, which contain a phenolic hydroxyl group, are included in the phenol type compounds unless otherwise specified.)

Concrete examples of the organic color developers include phenol type compounds, such as phenol, 4-phenylphenol, 4-hydroxyacetophenone, 2,2'-dihydroxydiphenyl, 2,2'-methylenebis (4-chlorophenol), 2,2'-methylenebis(4-methyl-6-t-butylphenol), 4,4'-isopropylidenediphenol (another name: bisphenol A), 4,4'-isopropylidenebis(2-chlorophenol), 4,4'-isopropylidenebis(2-methylphenol), 4,4'-ethylenebis(2-methylphenol), 4,4'-thiobis(6-t-butyl-3-methylphenol), 1,1-bis(4-hydroxyphenyl)-cyclohexane, 2,2'-bis(4-hydroxyphenyl)-n-heptane, 4,4'-cyclohexylidenebis(2-isopropylphenol) and 4,4'-sulfonyldiphenol; salts of these phenol type compounds; salicylic acid anilide; novolak type phenol resin; and benzyl p-hydroxybenzoate.

As other favorable phenol type compounds, there can be mentioned those having two or more functional groups and having phenolic hydroxyl groups of not more than 400 equivalents, preferably not more than 200 equivalents, for example, pyrogallol, resorcin, catechol and alkyl esters of gallic acid.

The above-mentioned favorable phenol type compounds include those having three or more functional groups, with the proviso that a part of the phenolic hydroxyl groups thereof forms a salt in the basic substance and they satisfy the above-defined conditions on the phenolic hydroxyl group equivalence.

Particularly preferred are alkyl esters of gallic acid because they are excellent in color developability, sharpness, weathering resistance and color undeveloping properties of the laser unirradiated portion.

The heat-sensitive color developing ink may contain a sensitizer for laser marking (also referred to as "laser marking sensitizer"). As the laser marking sensitizer, any sensitizers generally used for laser marking compositions may be employed. Of various sensitizers, preferred are borates, phosphates and silicates. The laser marking sensitizer is per se insoluble in the printing ink system, and therefore it is dispersed in the form of particles in the system. The diameter of the particle is usually not more than 10 μm, preferably in the range of 0.1 to 4 μm. The laser marking sensitizer may be beforehand subjected to a surface treatment with a titanium coupling agent, a silane coupling agent, metallic soap, a surface-active agent, a resin, etc. to increase dispersibility. Examples of the borates used herein include metal salts of boric acid, such as zinc borate, calcium borate, magnesium borate, lithium borate, aluminum borate, sodium borate, manganese borate and barium borate. These borates may contain bound water or may be anhydrides.

Examples of the phosphates include metal salts of phosphoric acid, such as zinc phosphate, calcium primary phosphate, calcium secondary phosphate, calcium tertiary phosphate, magnesium primary phosphate, magnesium secondary phosphate, magnesium tertiary phosphate, lithium primary phosphate, lithium secondary phosphate, lithium tertiary phosphate, aluminum phosphate, sodium primary phosphate, sodium secondary phosphate, sodium tertiary phosphate, potassium primary phosphate, potassium secondary phosphate, potassium tertiary phosphate, manganese phosphate, manganese ammonium phosphate, zirconyl phosphate, barium phosphate and apatite hydroxide. These phosphates may contain bound water or may be anhydrides.

Examples of the silicates include metal salts of silicic acid, cordierite that is a complex metal salt of aluminum silicate, mica (including natural mica such as muscobite, phlogopite, biotite and sericite, and synthetic mica such as fluorine gold mica and fluorine tetrasilicon mica), and zeolite (A type and B type). These silicates may contain bound water or may be anhydrides.

The color former and the color developer are used in such amounts that the weight ratio of the color former to the color developer is in the range of usually 0.1/1 to 5/1, preferably 0.5/1 to 3/1. The color former and the color developer are contained in the heat-sensitive color developing ink in such amounts that the total content of the color former and the color developer in the whole amount of the heat-sensitive color developing ink and the non-volatile component is in the range of usually 3 to 60% by weight, preferably 5 to 40% by weight.

The lower alcohol or the mixture solvent of lower alcohol and water is used in an amount of 10 to 90% by weight, preferably 20 to 70% by weight, in the heat-sensitive color developing ink.

The buffer solution gives a specific pH region depending on the ratio of the above-mentioned each composition, but there is no specific limitation on the pH region, and buffer solutions of all pH regions are useful. The buffer solution is used in an amount of 2 to 30% by weight, preferably 5 to 20% by weight, in the heat-sensitive color developing ink.

When the amino acid is added as its aqueous solution, it is used in an amount of 2 to 30% by weight, preferably 5 to 20% by weight, in the heat-sensitive color developing ink, though the amount varies depending on the solubility of the amino acid in water. When the amino acid in the solid form is added, it is used in an amount of 0.1 to 20% by weight, preferably 0.5 to 15% by weight.

The surface-active agent optionally added according to necessity is used in an amount of 0.05 to 10% by weight, preferably 0.1 to 3% by weight, in the heat-sensitive color developing ink.

There is no specific limitation on the amount of the water optionally added according to necessity, provided that no precipitation of a resin or the like used in combination therewith takes place. But, the water is used generally in an amount of 2 to 35% by weight, preferably 4 to 30% by weight, in the heat-sensitive color developing ink. When water is present as a solvent in the system, the above-mentioned water is added thereto. When the system is non-aqueous, the above-mentioned water is added alone.

The heat-sensitive color developing ink contains the color former, the color developer, the laser marking sensitizer and the ionizing material, or further contains the surface-active agent and/or water if necessary, in addition to the above components.

Owing to such a color developing ink layer 30 as described above, the color development of the ground can be inhibited to a minimum. Hence, laser printing with good visibility and high contrast can be carried out at a high speed on the heat-sensitive color developing printing area 22 of the label by means of a laser of low energy, without any occurrence of material destruction of the label.

Figure 4:
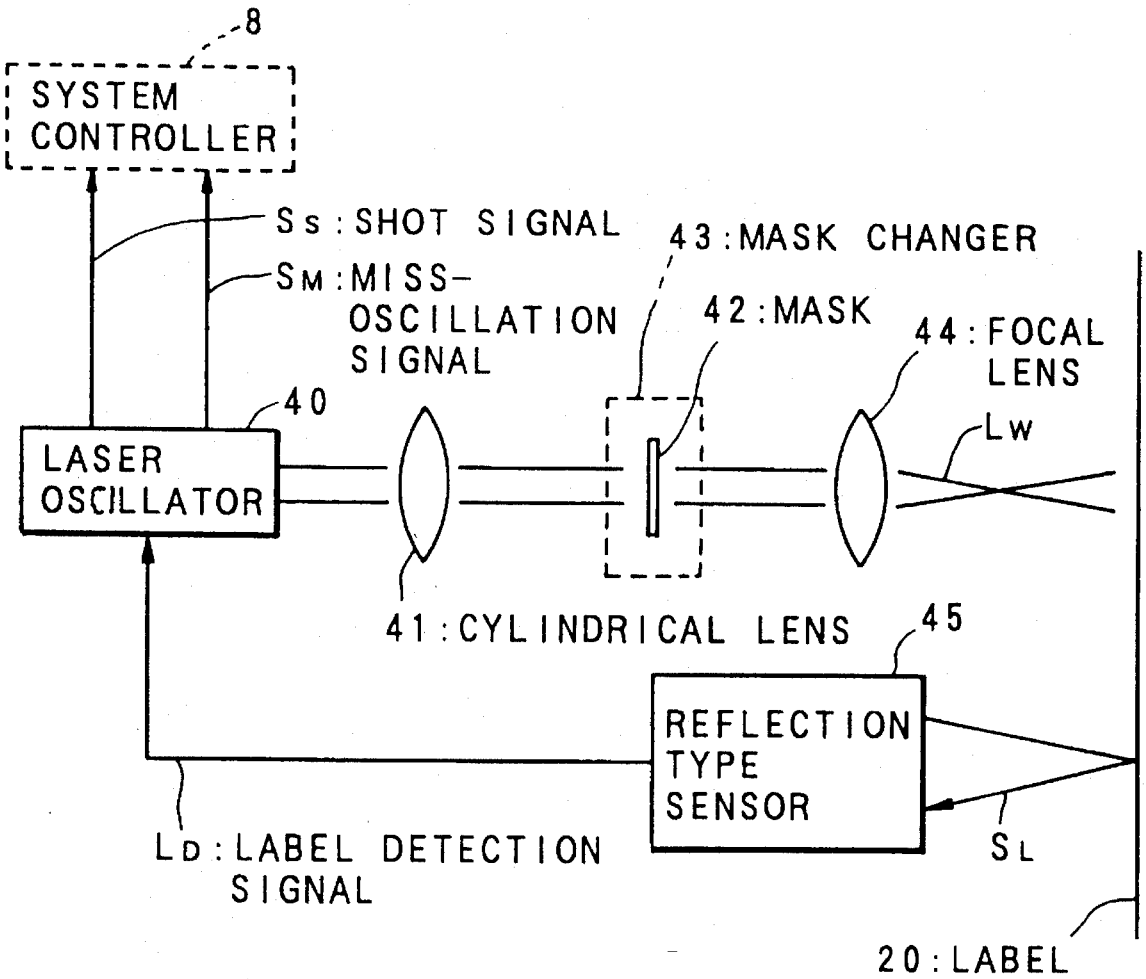
FIG. 4 is a block diagram showing a structure of a laser printing device.

FIG. 4 is a block diagram showing a structure of the laser printing device. The laser printing device 6 is provided with a laser oscillator 40, a cylindrical lens 41, a mask changer 43 to automatically change a mask 42, a focal lens 44 to converge the laser beam transmitted by the mask 42 and to focus the laser beam on the label, and a reflection type sensor 45. The laser oscillator 40 outputs a shot signal Ss when oscillation of a pulse laser is completed, and outputs a miss-oscillation signal Sm when the laser oscillation is unable to be conducted because of a trouble or the like. The cylindrical lens 41 adjusts energy density and irradiation area of the laser beam released from the laser oscillator 40. The mask 42 has a cutout of a letter made by etching or other means. The reflection type sensor 45 detects presence or absence of the label and outputs a label detection signal Ld directly to the laser oscillator 40.

In the above-described structure, the laser oscillator 40 is preferably a pulse type laser capable of providing an energy of not less than 0.1 $J/cm^2$·pulse, preferably not less than 0.2 $J/cm^2$·pulse to the surface to be irradiated, or a scanning type laser having an output of not less than 0.5 W. Examples of such lasers include a carbonic acid gas laser, a carbon monoxide laser, a semiconductor laser, an yttrium·aluminum·garnet (YAG) laser and an excimer laser. Of these, a Transversely Excited Atmospheric Pressure (TEA) type carbonic acid gas laser and a scanning type carbonic acid gas laser are preferred because black printing with good visibility can be made. Particularly, the pulse laser is preferably used as the laser oscillator 40. In the case of the scanning type laser, variation of a moving speed of the label causes a large shear or run in printing. In the case of the pulse laser, the energy of one shot is restricted and printing can be done with low energy.

As described above, by the color developing ink layer 30 of the label, sensitivity of the color developing printing area can be increased to a prominently high level as compared with the conventional one. As a result, the laser beam can be applied onto a wide area, whereby printing on a wide area becomes possible. Therefore, much information or complicated Chinese characters can be printed with a proper size. Further, the cutout letter on the mask 42 for giving the shape of the mark to the laser beam can be printed with an enlarged size of two or more times as large as the conventional size, so that the mask 42 and the mask changer 43 for moving the mask 42 can be minimized. Moreover, since splitting of the laser beam is not needed in order to carry out printing, that is, printing can be done with one shot, the optical system can be simplified (only one optical system is enough). As a result, cost of the printing apparatus can be lowered, and fine adjustment of the printing distance of each laser beam becomes unnecessary, though such adjustment is needed when the laser beam is split. In other aspect, the pulse laser makes it possible to print information on a wide surface area of two or more times as large as the conventional area, so that much information can be input at once, and moreover, much information can be printed on plural places at once by splitting the laser beam.

Furthermore, the fact that a laser beam having low energy density is enough brings about the following advantages. That is, destruction of the printing layer and the substrate layer, or evaporation of those layers hardly occurs. Since occurrence of dust can be avoided, equipment of a dust collector is not required. The printing cost can be reduced. The space can be saved. Durability of the optical system can be increased. In addition, since the overcoat layer 31, that is a protective layer of the label, is hardly evaporated, the label can be increased in durability.

As the reflection type sensor 45, a high-speed response type sensor having a response time of 0.05 msec can be employed. With respect to the detection sensitivity, the reflection type sensor is set to have a threshold value so that the label detection signal comes to a "L" level in the state where a label is not present (the state where only a pallet is present) and the label detection signal comes to a "H" level in the state where a label is present (detection of the heat-sensitive color developing printing area 22). In concrete, the heat-sensitive color developing printing area 22 has a light color in the initial state in order to print thereon a black letter. On the other hand, the pallet 2 has a dark color and has a larger difference in the lightness than the heat-sensitive color developing printing area 22. The reflection type sensor 45 utilizes a difference of the reflectance between the heat-sensitive color developing printing area 22 and the pallet 2 to detect the heat-sensitive color developing printing area 22. Further, the reflection type sensor 45 outputs the label detection signal Ld directly toward the laser oscillator 40, whereby occurrence of a shear in printing can be prevented. If the label detection signal Ld is output temporarily toward the system controller 8 which controls the labeling machine 1 to carry out laser printing, a scatter in the processing time caused by the time-sharing of the system controller 8 brings about the shear in printing. However, when the label detection signal Ld is output directly toward the laser oscillator 40 as described above, influence of the scatter in the processing time can be eliminated, and as a result, the shear in printing can be prevented.

Further, when the distance between the focal lens 44 and the mask 42 is varied by moving the focal lens 44, the printing magnification ratio (a ratio between the size of the cutout letter on the mask 42 and the size of the letter printed on the label 20) can be varied.

Next, the operation of the embodiment of the present invention will be described with reference to FIG. 5 and FIG. 6.

First, when a driving switch (not shown) of the labeling machine 1 is turned on at the time T1, the label driving signal comes to the "H" level (see: FIG. 5(*a*)) . As a result, the label magazine 5 moves to the operating position (see: FIG. 1). When moving of the label magazine 5 is completed at the time T2, the magazine output signal comes to the "H" level (see: FIG. 5(*b*)).

At the same time, the cylinder 3 and the pallet 2 on the cylinder 3 start to rotate, whereby a glue is applied onto the pallet 2 by means of the glue roller 4.

The pallet 2 with the glue applied as above rotates on its axis in accordance with the revolution of the cylinder 3.

When the pallet 2 moves to the front of the label magazine 5, it faces the label magazine 5 and receives the label 20 from the label magazine 5. As a result, the pallet 2 holds the label 20 by the applied glue, and simultaneously applies the glue onto the back surface of the label 20.

The pallet 2 holding the label 20 moves in accordance with the revolution of the cylinder 3 to the position where the pallet 2 faces the laser printing device 6. Then, the reflection type sensor 45 of the laser printing device 6 irradiates a label detection light $S_L$, and outputs a label detection signal $L_D$ that indicates presence or absence of the label 20 toward the laser oscillator 40. In concrete, the label detection signal $L_D$ comes to the "H" level when a high reflectance corresponding to the heat-sensitive color developing printing area 22 is obtained, while the label detection signal $L_D$ comes to the "L" level in other cases.

As a result, the laser oscillator 40 discriminates between presence and absence of the label by the label detection signal $L_D$ (step S1). When the label detection signal $L_D$ is on the "H" level, that is, the label is present (see: the time $T_3$ of FIG. 5(*c*)), the laser oscillator 40 immediately irradiates a pulse laser beam toward the mask 42 in the mask changer 43 through the cylindrical lens 41. The laser beam transmitted by the mask 42 is converged on the label 20 by the focal lens 44 to print various information (production date, lot number, factory number, etc.) (step S2).

Simultaneously with the above step, the laser oscillator 40 outputs a shot signal $S_S$ indicating completion of the irradiation with the laser beam toward the system controller 8.

The system controller 8 discriminates whether the output of the shot signal $S_S$ from the laser oscillator 40 is done or not within a given period of time from the time at which the previous shot signal $S_S$ is output in the state where the magazine output signal is on the "H" level and the label driving signal is on the "H" level (step S3). If the shot signal $S_S$ is not output within the given period of time, the system controller 8 judges an error of the reflection type sensor 45 occurs, and outputs a reject signal $S_R$ toward the rejecting device 9 (see: FIG. 1) provided on the rear side of the belt conveyer C for conveying bottles (step S8). As a result, the rejecting device 9 removes the corresponding product, namely, a product attached with a label on which no information is printed, as a defective.

Figures 5A, 5B, 5C, 5D, 5E:
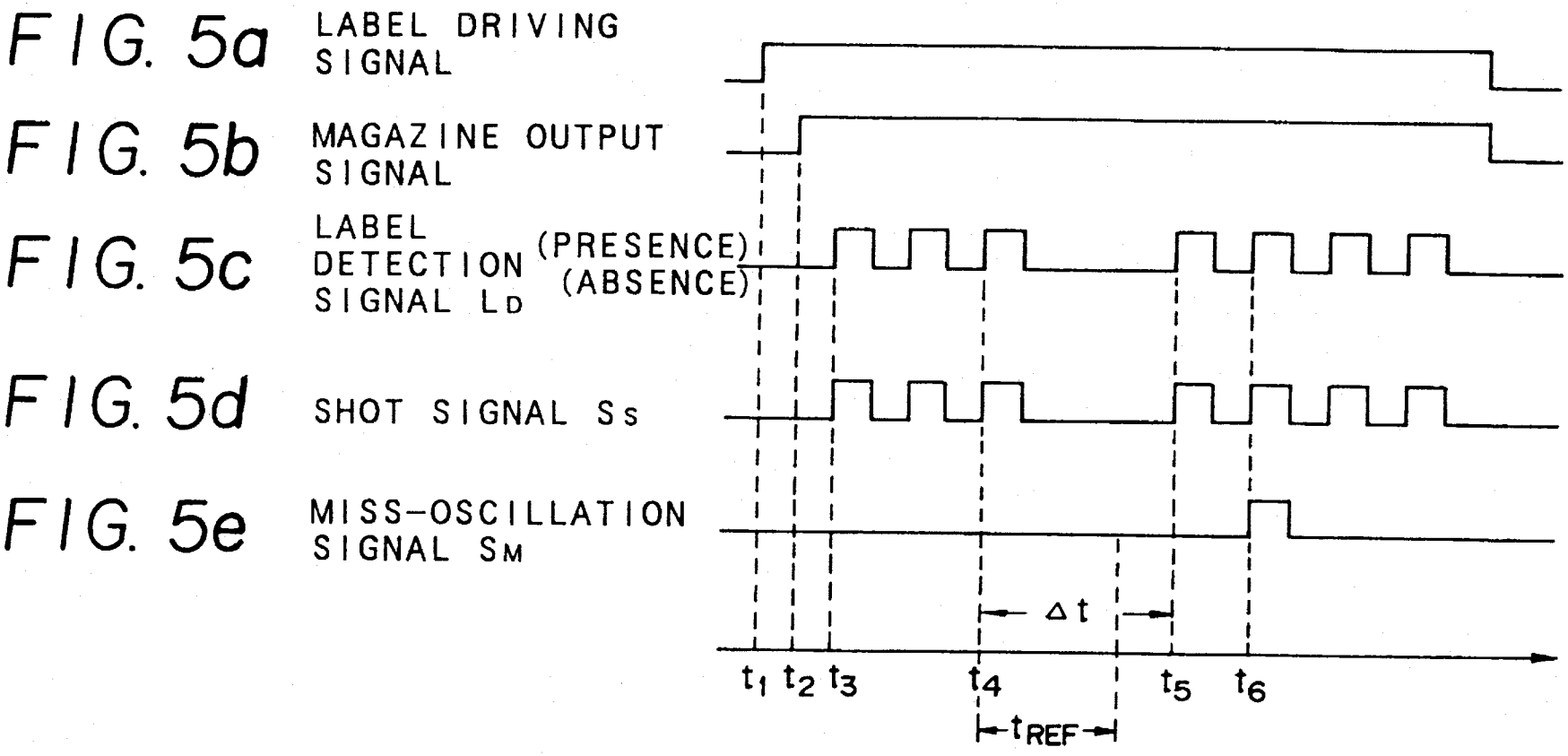
FIG. 5*a–e* is a timing chart illustrating a label printing motion of a labeling machine.
Figure 6:
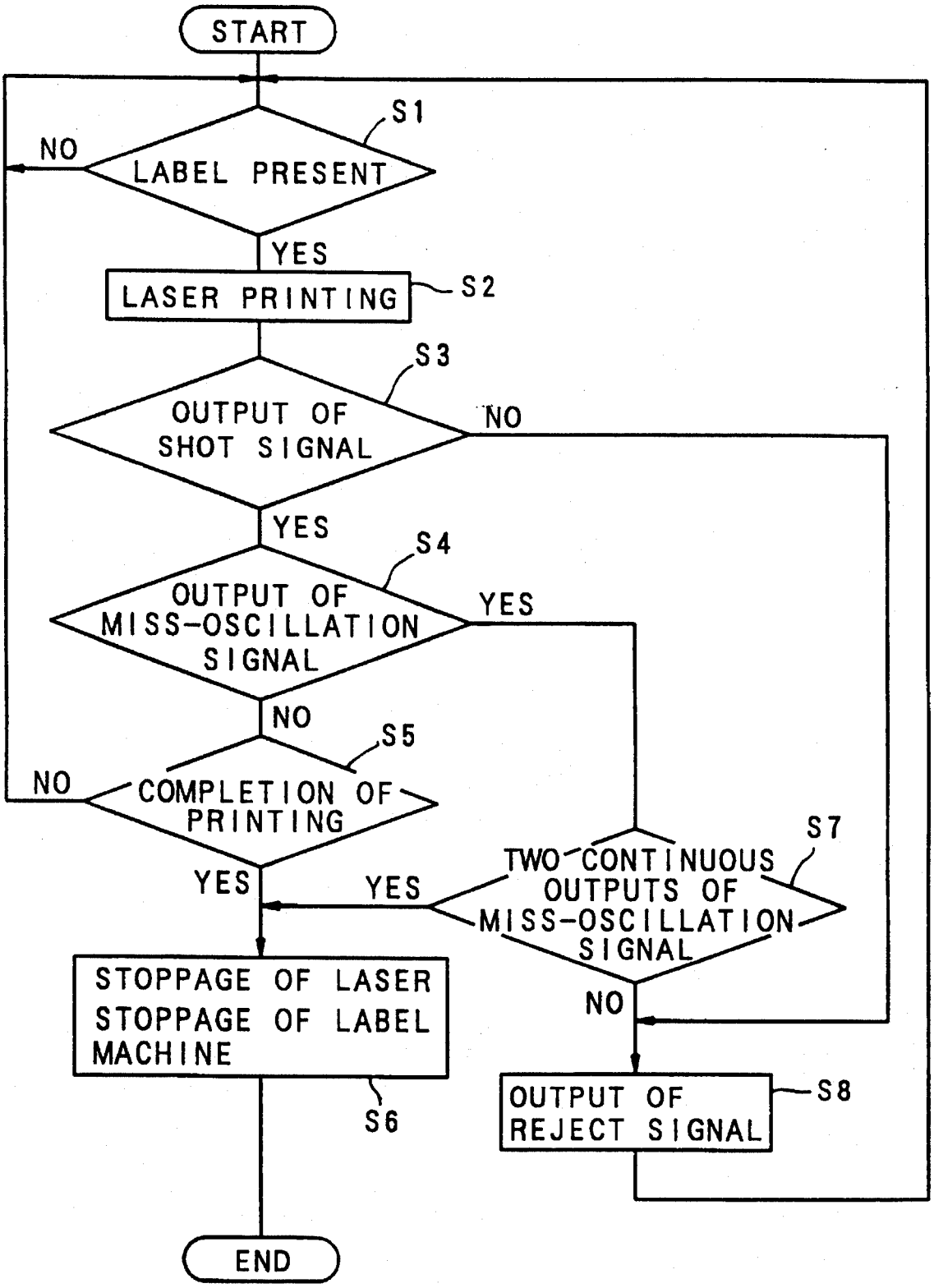
FIG. 6 is a flow chart illustrating a label printing motion of a labeling machine.

In concrete, as shown in FIG. 5, when a period of time $\Delta t$ from the time at which the shot signal $S_S$ comes to the "H" level at the time $t_4$ to the time at which the next shot signal $S_S$ comes to the "H" level at the time $t_5$ is longer than the reference period of time $t_{REF}$ in the state where the magazine output signal is on the "H" level and the label driving signal is on the "H" level, the system controller 8 outputs a reject signal $S_R$ toward the rejecting device 9.

On the other hand, when the system controller 8 judges the shot signal $S_S$ (FIG. 5(*d*)) is output within the given period of time in the discrimination of the step S3, the system controller 8 then discriminates whether the miss-oscillation signal $S_M$ has been output or not (step S4).

The miss-oscillation signal $S_M$ is now described.

In some cases, the laser oscillator 40 is unable to release a laser beam because of voltage lowering or the like. This phenomenon is referred to as "miss-shot". Usually, the miss-shot takes place in a probability of about 10 ppm. Supposing about 300,000 to 700,000 bottles of beer are produced per line each day in a process for preparing bottled beer, the above-mentioned miss-shot probability corresponds to occurrence of defectives of 3 to 7 bottles per line. Accordingly, if the miss-oscillation signal $S_M$ is output at the time when the laser oscillator 40 itself detects the miss-shot, defectives can be easily removed without adding any step for checking defectives as a post step.

If it is confirmed in the discrimination of the step S4 that the miss-oscillation signal $S_M$ is not output, the printing of information is correctly carried out, so that whether the printing is completed or not is then discriminated. If the printing is not completed, processing is again transferred to the step S1, and the operations of the step S1 to the step S5 are repeated until the printing of information is completed.

When the printing is completed, the laser oscillator 40 is stopped and the labeling machine 1 is also stopped (step S6). Thus, the whole process is completed.

On the other hand, when the output of the miss-oscillation signal $S_M$ is confirmed in the discrimination of the step S4 (see: the time $t_6$ of FIG. 5(*e*)), the system controller 8 discriminates whether the miss-oscillation signals $S_M$ is output twice continuously or not (step S7).

If it is confirmed in the discrimination of the step S7 that the miss-oscillation signals $S_M$ is output twice continuously, occurrence of a trouble with the laser oscillator 40 is assumed. Accordingly, the laser oscillator 40 is stopped and the labeling machine 1 is also stopped. At the same time, occurrence of the trouble (accident) is displayed on a display device (not shown) to let the operator know it.

When a single output of the miss-oscillation signal $S_M$ is confirmed in the discrimination of the step S7, it is assumed that a temporary operation error occurs in the laser oscillator 40, and the system controller 8 outputs the reject signal $S_R$ toward the rejecting device 9 provided on the rear side of the belt conveyer C for conveying a bottle B (step S8). As a result, the rejecting device 9 removes, as a defective, the corresponding product, namely, a product attached with a label on whose heat-sensitive color developing printing area 22 is printed no information.

According to the present invention, as described above, the label detection signal $L_D$, that is an output signal from the reflection type sensor 45, is directly input into the laser oscillator 40, and hence a shear in printing can be prominently reduced (about not more than 0.3 mm). Further, since the reflection type sensor 45 is able to easily detect whether the label 20 is held in the correct position by the pallet 2 or not, any error in operation does not occur. Moreover, if the label 20 is not held by the pallet 2, printing by the laser beam is not carried out. Therefore, electric power is not wasted, and the pallet 2 for holding the label 20 is not damaged by irradiation with the laser beam.

Furthermore, since the accuracy in printing is increased, the heat-sensitive color developing printing area can be made smaller, resulting in reduction of the cost for preparing a label.

Still further, even when a defective is produced due to miss oscillation of the laser oscillator 40 or other reason, the defective can be easily removed, and production of products with high reliability is possible. In addition, it is unnecessary to provide any print check machine to the post-processing stage, resulting in drastic reduction in cost and saving in space.

In the above embodiment, described is that printing is carried out on the label of one kind. However, even when the kind of the label is varied, printing on various kinds of labels can be carried out by automatically setting the threshold value of the reflection type sensor from the outside of the system in conformity with the label on which printing is to be made. In concrete, the threshold value is set to an intermediate value between the reflectance of the pallet and the reflectance of the heat-sensitive color developing printing area.

According to the present invention, as mentioned above, it is surely and rapidly detected by the sensor that the label to be printed with various information by the laser beam is present in the predetermined printing position, and the printing of information is automatically carried out only when the label is present in the predetermined printing position. Accordingly, the label printing apparatus can be easily controlled and the apparatus is free from any useless motion. Further, the printing can be carried out in the correct position at a high speed, whereby occurrence of a defective can be reduced.

As the present invention may be embodied in other various forms without departing from the spirit or essential characteristics thereof, the embodiment described above is therefore illustrative and not restrictive. The scope of the present invention is defined by the appended claims rather than by the description preceding them, and all changes that fall within bounds of the claims, or equivalence of such bounds are therefore intended to embraced by the claims.

What is claimed is:

1. A label printing apparatus to print given information by means of a laser beam on an information printing area of a label, said information printing area having a heat-sensitive color developing ink layer; said label printing apparatus including:

a label feed means for successively feeding plural labels to predetermined printing positions;

a laser printing device which is provided with a sensor and a light source, said sensor serving to discriminate between presence and absence of the label in the predetermined printing position and to output a label detection signal, said light source serving to release the laser beam, and which receives the label detection signal directly from the sensor, prints the information on the label by means of the laser beam when the presence of the label in the predetermined printing position is confirmed by the label detection signal, and outputs a shot signal; and a controller means for determining whether an output interval between successive shot signals is within a given period of time or not and to output an error signal when the output interval between the shot signals is not within the given period of time.

2. The label printing apparatus as claimed in claim 1, wherein the sensor is a reflection type sensor and outputs the label detection signal based on whether the reflectance of the obtained reflected light is almost equal or not to the predetermined reflectance corresponding to the information printing area.

3. The label printing apparatus as claimed in claim 1, wherein the light source is a pulse laser oscillator.

4. The label printing apparatus as claimed in claim 1, further including a rejecting device which removes a product having thereon an improperly positioned label corresponding to the error signal when it receives the error signal from the controller.

5. The label printing apparatus as claimed in claim 1, wherein the laser printing device includes an oscillator which outputs a miss-oscillation signal to the controller when the light source is unable to release a laser beam.

6. The label printing apparatus as claimed in claim 5, wherein the controller outputs an error signal in response to the miss-oscillation signal is output from the oscillator.

7. The label printing apparatus as claimed in claim 6, further including a rejecting device which removes a product having thereon an improperly positioned label corresponding to the error signal when it receives the error signal from the controller.

8. The label printing apparatus as claimed in claim 1, wherein the label feed means is provided with a cylinder having plural pallets, a glue roller for feeding glue to the pallets and a label magazine for feeding labels to the pallets.

9. The label printing apparatus as claimed in claim 1, wherein the heat-sensitive color developing ink layer contains at least a color former, a color developer, a ground color inhibitor and a binder resin.

10. The label printing apparatus as claimed in claim 9, wherein the ground color inhibitor is a material comprising at least one element selected from the group consisting of amino acids, ammonium salts, a pH buffer solution, water and a surface-active agent.

11. The label printing apparatus as claimed in claim 9, wherein the binder resin is a neutral resin which is soluble in either a lower alcohol or a mixture of a lower alcohol and water and is capable of forming a film, and the heat-sensitive color developing ink layer contains a lower alcohol or a mixture of a lower alcohol and water as a solvent before it is subjected to drying.

12. The label printing apparatus as claimed in claim 9, wherein the color former is a leuco dye and the color developer is an acid material.

13. The label printing apparatus as claimed in claim 12, wherein the acid material is a phenol type compound.

14. The label printing apparatus as claimed in claim 13, wherein the phenol type compound is a gallic acid derivative.

15. The label printing apparatus as claimed in claim 9, wherein the heat-sensitive color developing ink layer further contains a sensitizer.

16. The label printing apparatus as claimed in claim 15, wherein the sensitizer is an insoluble compound comprising at least one element selected from the group consisting of borates, phosphates and silicates.

* * * * *

UNITED STATES PATENT AND TRADEMARK OFFICE

CERTIFICATE OF CORRECTION

PATENT NO. : 5,528,280

DATED : June 18, 1996

INVENTOR(S) : Norio ENDO, et al.

It is certified that error appears in the above-indentified patent and that said Letters Patent is hereby corrected as shown below:

On the title page, in Item [75], the Inventors should read:

-- [75] Norio Endo; Yasuharu Sawahara; Naoyuki Nagae; Shinichi Ogata, all of Tokyo; Toshiyuki Kiyonari, Hasuda; Yoshio Takimoto, deceased, late of Tokyo; by Kazumi Takimoto, Tokyo, heir; Takeshi Takimoto, Tokyo, heir; Toshihiko Yasui, Yokohama; Katsuhiko Kawakami, Shisui-machi, all of Japan. --

Signed and Sealed this

Thirty-first Day of December, 1996

*Attest:*

Bruce Lehman

BRUCE LEHMAN

*Attesting Officer*

*Commissioner of Patents and Trademarks*